United States Patent [19]

Leis et al.

[11] 3,983,451

[45] Sept. 28, 1976

[54] SCAN CONTROL CIRCUIT FOR A VIDEO TERMINAL DISPLAY DEVICE USING FEEDBACK TO CONTROL SYNCHRONIZATION

[75] Inventors: Michael Leis, Framingham; Russell C. Doane, Concord, both of Mass.

[73] Assignee: Digital Equipment Corporation, Maynard, Mass.

[22] Filed: Apr. 24, 1975

[21] Appl. No.: 571,139

[52] U.S. Cl. ..... 315/387

[51] Int. Cl.[2] ..... H01J 29/70

[58] Field of Search ..... 315/387, 388

[56] References Cited

UNITED STATES PATENTS

| | | | |
|---|---|---|---|
| 2,852,717 | 9/1958 | McCurdy | 315/388 |
| 3,179,842 | 4/1965 | Brooks | 315/388 |
| 3,435,280 | 3/1969 | Havn | 315/387 |
| 3,748,527 | 7/1973 | Pluck | 315/387 |

*Primary Examiner*—Maynard R. Wilbur
*Assistant Examiner*—David Leland
*Attorney, Agent, or Firm*—John M. Gunther; Thomas C. Siekman

[57] ABSTRACT

In a video terminal system wherein a number of characters are to be displayed on each forward horizontal scan, a scan control circuit is utilized to synchronize the displaying of characters with the scanning of the cathode ray tube. Both the scan control circuit and the displaying characters are tied to a timing chain. Since the displaying of characters occurs at a fixed predetermined time in the timing chain, the scan control circuit is required to control the movement of the scan such that the phase of the scan is regulated in time. The scan control circuit accomplishes synchronization by a self-regulating feedback circuit which controls the magnitude of the base drive to a power transistor. Since the storage time of a power transistor is proportional to the magnitude of the base drive current to the power transistor, a simplified circuit results which accurately places the characters at a fixed position. The self-regulating feedback circuit also assures that the power transistor is precisely driven regardless of its parameters.

14 Claims, 3 Drawing Figures

SCAN CONTROL CIRCUIT FOR A VIDEO TERMINAL DISPLAY DEVICE USING FEEDBACK TO CONTROL SYNCHRONIZATION

BACKGROUND OF THE INVENTION

1. Field of the Invention

This invention generally relates to video terminal devices and more specifically to a circuit for controlling the scan to a display device.

2. Related Inventions

This invention is used in conjuction with the invention described in Ser. No. 516,348, filed on Oct. 21, 1974, by Michael D. Morganstern et al. and assigned to the same assignee as the present invention.

3. Description of the Prior Art

In conventional television circuits, a cathode ray tube has a series of dot patterns displayed on its screen which form either alphanumeric characters or pictures. The display is formed by a beam which horizontally scans the entire surface of the cathode ray tube and an electronic gun in the neck of the cathode ray tube which shoots out a series of dots during each horizontal scan.

The scan consists of a forward and backward portion with part of the forward portion being used for displaying the dots from the electronic gun. Vertical adjustment such that each forward scan does not occur in the same location is also provided. When all the forward horizontal scans for the screen have been displayed, the scan is set back to its original, i.e. upper right, position such that another viewing of the dot pattern is provided. This happens at fast speeds as is apparent by the fact that it is impossible to see the dot patterns as they are forming the alphanumeric characters or pictures on the cathode ray tube screen.

It has been found worthwhile in the computer industry to utilize the cathode ray tube as a display device for reading out computer information. However, not all of the television technology related to the control of the scan is desirable or applicable. Thus, in the television industry, a free-running oscillator is synchronized to a composite signal generated from the transmitter of the television station to provide for the display on the screen. In a computer, however, no composite video signal is ever provided. Moreover, it is desirable to obviate other circuitry used in the television industry.

The present invention eliminates the free-running oscillator and the composite video signal of the television industry. It does this by making use of a standard digital crystal clock oscillator which provides precisely timed pulses. This crystal clock oscillator is used to control the timing of the scan as well as the timing of the video signal applied to the scan.

Another deterrence for the computer industry in using television circuitry is that the television industry overscans the display on the cathode ray tube screen. By overscanning is meant that the beam is displayed beyond the extremities of the screen. With part of the picture being off the screen, a percentage of the information which has been transmitted to the sceen is lost. While this is immaterial in the television industry since the essential part of the picture is captured on the visible portion, it is unacceptable in the computer industry since the time needed to display the information is severely limited.

For example, in computer industry the typical number of characters displayed per horizontal line is 180.

This means that the cathode ray tube must have 80 characters provided to it within the visible (usable) portion of the forward scan of the beam. Since the time for a scan cycle is fixed, the time when this information is able to be displayed must be maximized. Thus, if overscanning is provided, a lesser percentage of the forward scan time is usable to present the characters on the screen. This time, in the video terminal application means that a faster character generator to process the characters to be displayed on the video screen is necessary with the result that the character generator would be much more expensive and beyond the state of present high yield technology.

In order to maximize the display time, the computer industry utilizes underscanning. As used herein, underscanning means that the scan is regulated such that it does not extend beyond the boundaries of the screen. Obviously, this also allows the character generator providing the display characters to be slower and consequently cheaper. However, this requires precise control of the time between the start of the display of information and the movement of the beam.

One of the specific problems involved in increasing the time to display characters on a screen involves the control of a power transistor which initiates retracing of the beam. In the television industry, the power transistor is oversaturated, i.e., it is driven as much as possible, so as to be sufficient for the worst case gain transistor. This results in a high desaturation time and the expense of extra power supplied to the power transistor. Because of the parameters involved in the television industry, both overscanning and extra power are permissible. However, in the computer art, underscanning is required and retrace time becomes critical. As a result, the oscillator and phase lock loop must be eliminated while the timing of scan and the scan's overall regulation must be controlled so that the first character appears at the proper place in the forward portion of the scan.

OBJECTS OF THE INVENTION

It is therefore an object of the invention to overcome the prior art limitations and enable a cathode ray tube to be used in a computer device.

It is a primary object of this invention to provide an efficient low cost circuit which controls the scanning on a display device.

It is another object of this invention to provide a circuit which maximizes the utilization of a power transistor by controlling its saturation and storage time in a scan control circuit.

It is yet another object of this invention to provide a scan circuit incorporating a feedback circuit which is self-regulating and which maximizes the forward scan time for displaying characters.

SUMMARY OF THE INVENTION

The subject matter of this invention performs the above functions by providing a self-regulating scan control circuit which synchronizes the displaying of characters to the position of the scan on a display device. The circuit includes a first timing signal which stops the base current to a power transistor. After a delay based on its saturation, the power transistor stops conducting current to a transformer. This causes a change in thecurrent supplied to the transformer which enables the scan to retrace. The transformer has a voltage spike introduced across its secondary, the voltage spike being transferred to a feedback circuit.

The feedback circuit includes a capacitor which is responsive to the charge provided from the voltage spike and is also responsive to a second timing signal which occurs a predetermined time after the first timing signal. The second timing signal inhibits the charge from the voltage spike from going to the capacitor. Based on the charge in the capacitor, the feedback circuit regulates the current provided to the base of the power transistor and thus regulates its saturation. A third timing signal which occurs at a predetermined time after the second signal then enables the displaying of the characters on the cathode ray tube screen. By the feedback circuit controlling the current to the power transistor, the time to desaturate the power transistor is regulated. Moreover, this entire circuit makes the phase (or time position) of the scan proportional to the magnitude of the base drive current and thereby controls the scan of the beam in order to allow the synchronized displaying of characters.

DESCRIPTION OF THE DRAWINGS

For a fuller understanding of the nature and object of the invention, reference should be had to the following detailed description taken in conjunction with the accompanying drawings in which.

DETAILED DESCRIPTION OF THE PREFERRED EMBODIMENT

Figure 1:
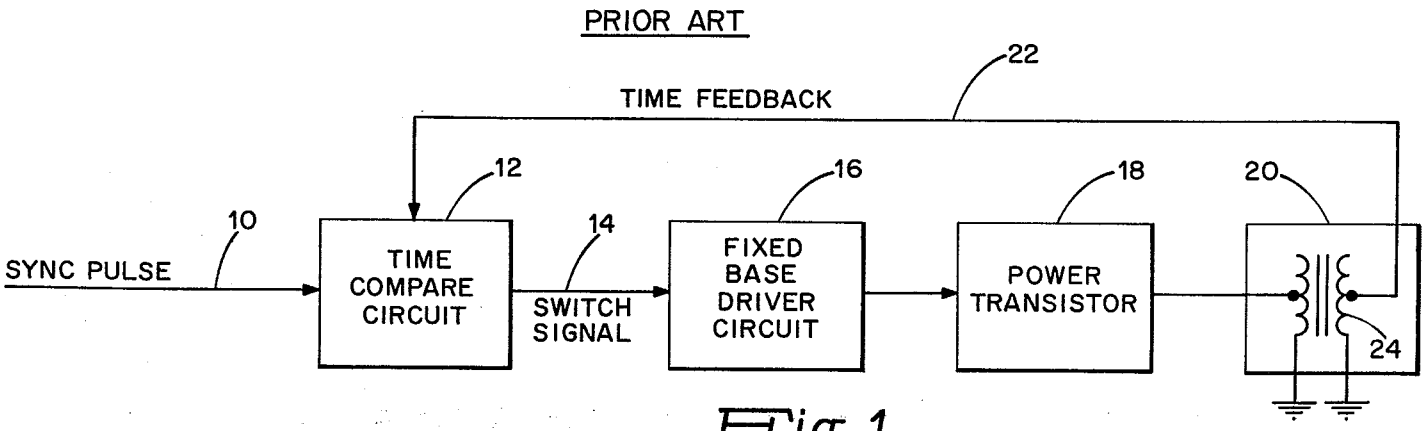
FIG. 1 is a simplified block diagram showing the prior art scan control circuit.

FIG. 1 shows a simplified block diagram of a prior art scan circuit used by the television industry for controlling the scanning of a cathode ray tube. An external signal called a sync pulse 10 is provided to a time compare circuit 12. The external signal may come from a transmitter (not shown) generating video signals. This signal phase locks the beam position by controlling the frequency and phase of a free-running oscillator (not shown) in the time compare circuit 12 thereby matching the beam position to the sync signal. The oscillator is regulated to control phase drive time. In response to the output of compare circuit 12, a switch signal 14 is provided to a fixed magnitude base driver circuit 16. A constant current is generated from driver 16 to a power transistor 18 which controls the scan to a display device (not shown). When switch signal 14 is low, the base current to power transistor 18 is shut off which causes circuit 20 to have its transformer 24 resonate. Moreover, the disabling of circuit 20 results in the beam being retraced, i.e., deflect back to the next line, so that the next forward scan begins. Circuit 20 is tied to time compare circuit 12 by time feedback line 22. The compare circuit 12 samples the time when the transformer resonates, i.e., the time when flyback occurs, and locks the phase to the external sync pulse signal 10.

In the television industry, there is overscanning of the display device as well as oversaturation of the power transistor 18. More specifically, base driver circuit 16 always provides a high constant current to power transistor 18 which results in oversaturation of power transistor 18. This high constant current is required since the power transistor 18 may have different parameters, e.g., fast switching time, high beta, etc., resulting in different requirements for each transistor. It is essential that saturation of power transistor occurs, and hence, the high constant current from driver 16 is designed to saturate the worst case power transistor 18. This, however, results not only in extra power being required by transistor 18 but also the worst possible storage time for transistor 18.

Storage time is the time to get rid of the base drive current from the power transistor 18. Once this charge is removed, the transistor then shuts off. Because there is worst case saturation of the power transistor 18, the storage time becomes significant. By controlling the base drive to the transistor not only may the storage time be minimized but also the different parameters of the particular transistor 18 are accounted for. This results in control of the scan as well as optimization of the time for displaying characters in the scan.

A typical scan cycle for a display device is 65 microseconds. Of this time, approximately 11 to 13 microseconds are allocated for the retracing of the scan. The actual time to retrace the scan is fixed by the parameters of the circuit 20. However, the total retrace time is affected by the saturation of power transistor 18 since it takes variable amount of time to render transistor 18 into a desaturated state. Although the time from mere saturation to desaturation is a constant and an inherent parameter of the transistor, the time from oversaturation to mere saturation is a variable and for video application is considered extra since this time takes away from the time for forward scanning.

The problem of not only having a predetermined time phase for retrace but also as small a retrace time as possible is accentuated in the present apparatus since there may be no phase locking to a composite video signal. The apparatus of the present invention, however, overcomes this problem and provides for time correction as well as synchronization of the scan to the display of the alphanumeric characters. Moreover, this is accomplished with the elimination of the oscillator and the phase lock loop circuit.

Figure 2:
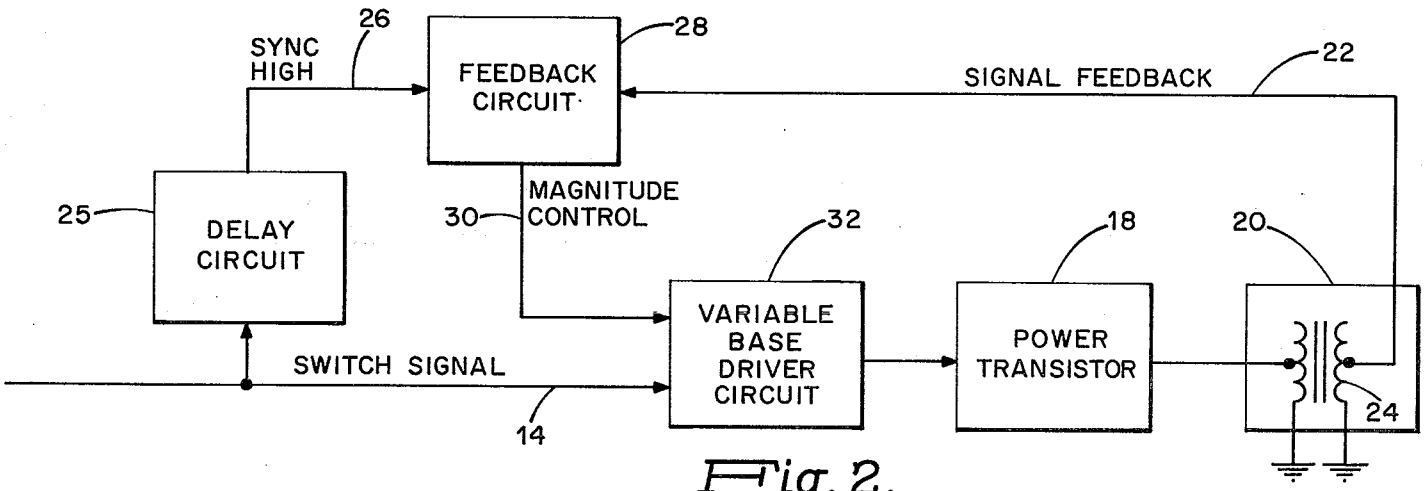
FIG. 2 is a simplified block diagram showing the circuit of the present invention.

Referring to FIG. 2, a switch signal 14 is provided by a composite video signal or, more likely, by a digital clock (not shown) which controls the timing of the system. The digital clock may be a crystal clock oscillator which provides a timing chain having precisely timed signals. The signals from the digital clock occur in timed intervals which may be, for example, a 65 microsecond cycle. The clock signals are in the form of a square wave having a transition every 32.5 microseconds.

On the trailing edge of the square wave, a switch signal 14 is provided to variable magnitude base driver circuit 32. The trailing edge of the switch signal enables the current to the varible magnitude base driver 32 which in turn draws current from the base of a power-transistor 18. This trailing edge of the switch signal is the command to start retrace of the scan. When power transistor 18 desaturates, circuit 20 with transformer 24 begins to resonate. As a result, a feedback signal, which may be a voltage or current spike, is generated in the secondary of transformer 24. A voltage feedback line 22 is coupled to the secondary of the transformer 24 and transfers the feedback signal to feedback circuit 28. Obviously, this signal could be obtained from the primary if so desired.

As an additional input, feedback circuit 28 receives a second timing signal, sync high, 26 from the digital clock. This signal begins at the same time as the switch signal 14 but is of a very short fixed duration. When the second timing signal 26 ends, it inhibits transfer of the feedback signal via line 22. Timing signal 26 may be generated independently or from switch signal 14 via any known delay circuit 25 such as a monostable multivibrator as is well known in the art. Depending upon the time the voltage or current spike is provided to feedback circuit 28, i.e., the time when the second timing signal is active, the charge stored by feedback circuit 28 is varied. This varied charge in turn controls the magnitude of the current provided over line 30. In response to the varied current over line 30, variable base driver 32 provides a proportional current into the power transistor 18. This current controls the saturation of transistor 18.

If the power transistor 18 was in an oversaturated condition, as compared to a mere saturated condition, it would require a significant time to stop conducting. Only after this time is the voltage or current spike induced in the secondary of transformer 24. Since the timing signal over line 26 is generated at the same time as the switch signal 14 enables conduction in circuit 32 and since the second timing signal is provided for only a short fixed time period thereafter, if the voltage spike occurs late in the cycle, feedback circuit 28 will only receive a small portion of the voltage or current spike, and hence, will store only a small incremental charge. This charge results in a lower conduction over magnitude control line 30 to variable base driver circuit 32 which in turn limits the current to power transistor 18. This lesser amount of base drive current will then result in power transistor 18 becoming less saturated during the next cycle of operation.

Conversely, if the power transistor 18 is undersaturated, if will stop conducting much faster and consequently, the voltage or current spike presented by transformer 24 over line 22 to feedback circuit 28 will be much longer for the period of the second timing signal 26. This will increase the charge provided to feedback circuit 28 and results in a greater current being provided over line 30 to variable base driver circuit 32. On the next cycle, the increase in the amount of current provided to power transistor 18 results in a higher degree of saturation of the power transistor.

The amount of saturation of power transistor 18 is inversely proportional to the time when the voltage spike from the secondary 24 is transferred to feedback circuit 28. Because of this relationship and because feedback circuit 28 controls the current to saturate power transistor 18, the timing relationships for scan control is easily regulated. Moreover, because of the feedback relationship which is established, time correction for the scan is automatically implemented. Finally, the feedback relationship also accounts for the various parameters of transistor and optimizes the functioning of the transistor. This will be more readily apparent when viewing FIG. 3 which shows a detailed circuit diagram.

Figure 3:
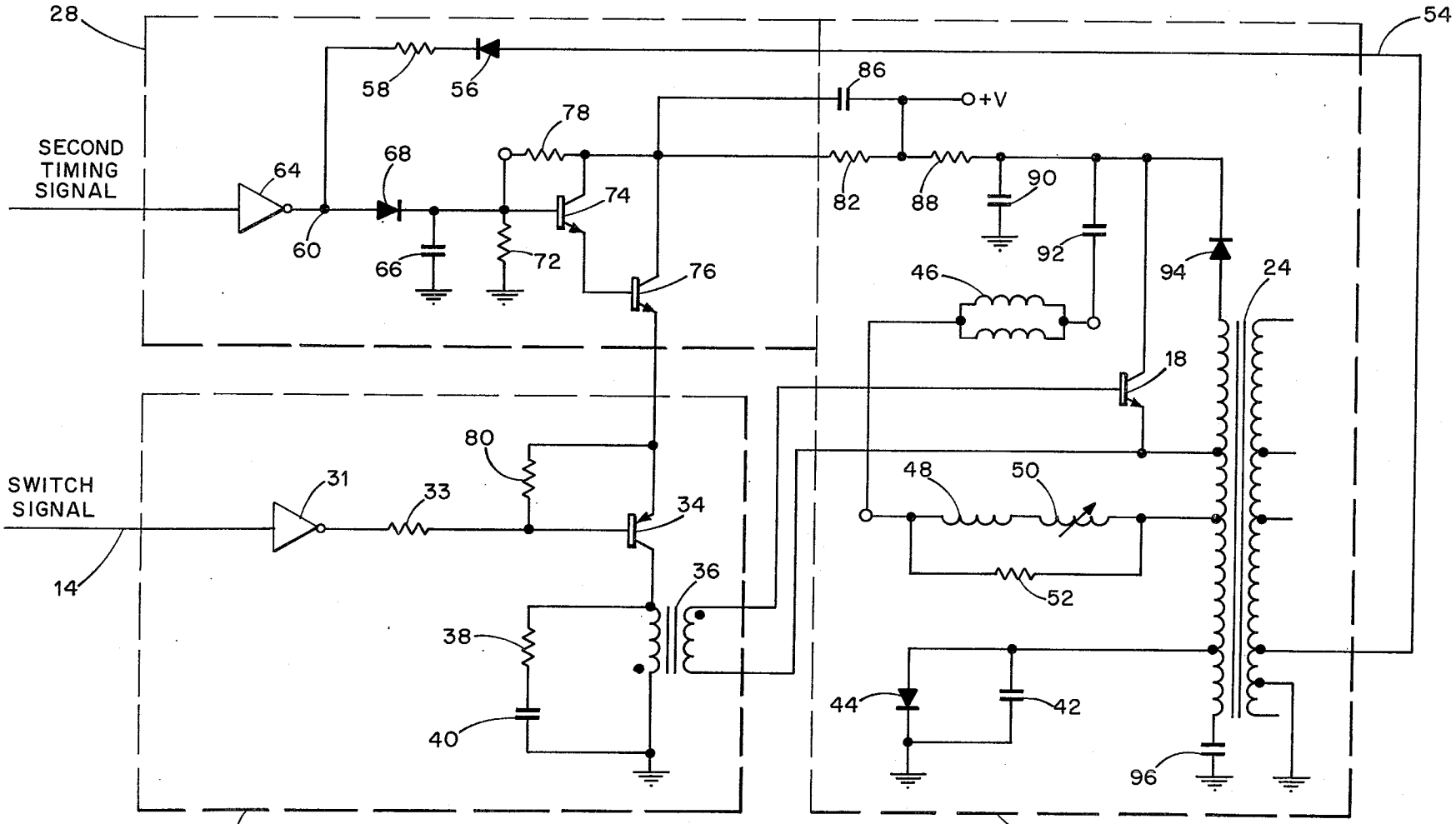
FIG. 3 is a simplified circuit schematic showing the scan control circuit including the feedback circuit for controlling the scan to a display device.

More specifically, and referring to FIG. 3, the switch signal 14 is provided to variable base driver circuit 32. This signal is received by inverted amplifier 31 coupled in series to a resistor 33. The amplifier 31 and resistor 33 are used for isolation from the other circuits in the video terminal such as the audio and video circuit and also for increasing the power to the variable base driver circuit 32.

The digital clock that supplies the switch signal 14 also supplies another timing signal to a microprocessor (not shown). This timing signal is delayed for a fixed time from the trailing edge of the switch signal and enables the video character generator (not shown) to supply the alphanumeric characters to the display device. Thus, the generation of these characters is fixed to the timing chain and occurs at a predetermined time after the switch signal 14. The problem then is one of how to make the scan synchronized to the display of the alphanumeric characters so that the characters are displayed in a controlled horizontal position. Since the scan is essentially an analog beam, a timing relationship must be established and the circuit of FIG. 3 provides for the synchronization.

On the trailing edge of the square wave of switch signal 14, the base current to PNP 34 transistor is turned on. When transistor 34 becomes enabled, transformer 36 coupled to the emitter of transistor 34 starts receiving current. This causes a reverse in the direction of the current flow in transformer 36. This reversal is coupled to the secondary of transformer 36 resulting in a cut off of current to the base of power transistor 18. The RC circuit 38 and 40 provide current to power transistor 18 when the leading edge of the square wave turns off transistor 34.

The time to desaturate transistor 18 is related to the charge stored in its base. If power transistor 18 has been oversaturated, there will be a longer time necessary to remove this charge in order to render transistor 18 nonconductive. This time may be approximately 0.5 to 1 microseconds from mere saturation. If this same transistor is oversaturated, the time for transistor 18 to be rendered nonconductive may be 4 microseconds. If this longer time is required to initiate retrace, the remaining portions of the scan are adversely affected. Considering that the alphanumeric characters are provided by the timing chain at a fixed time and each character is displayed in approximately 650 nanoseconds, several characters may be lost if the transistor is in its oversaturation condition.

When power transistor 18 is conducting, current flows through its emitter to transformer 24 and then through inductors 48 and 50 to yoke 46 on the neck of the cathode ray tube. Yoke 40 is an inductor which generates a magnetic field to deflect the beam based on the current it receives. Inductors 48 and 50 are second order elements which provide a current source to yoke 46. Resistor 52 which is in parallel with inductors 48 and 50, is a damping resistor which mitigates ringing in the inductors.

When the command to retrace is given, i.e., on the trailing edge of switch signal 14, transistor 18 begins to desaturate. When desaturated, current through its emitter is halted. Since yoke 46 still requires current, it is supplied by capacitor 42 through transformer 24 and inductors 48 and 50. Capacitor 42, in parallel with diode 44, initially has a low voltage. By supplying current to inductor 46, its voltage becomes negative. This in turn results in a change of polarity across inductor 46, and consequently, a change in the direction of movement of the scan. The overall control of the scan by this circuit is well known in the art and is not described herein in further detail.

As a result of these changes, two events occur. First, the current through transformer 24 is changed resulting in a voltage or current spike being generated across the secondary. Second, the current to yoke 46 is lessened resulting in retrace for the scan.

The voltage or current spike across the secondary lasts for approximately 10 to 13 microseconds and is transferred back to feedback circuit 28 via line 22. The voltage spike may be of the order of 100 volts with the upper portion of the secondary having a 11000 volt spike.

The voltage or current spike over line 22 is provided through isolating diode 56 and resistor 58 to provide a current to point 60. Point 60 is also effected by the second timing signal 26 derived from the timing chain previously described. The signal 26 is low beginning with the switch signal 14 and remains low for a predetermined time period determined by delay circuit 25. This period may, for example, be 5.2 microseconds. At the end of this time, the signal 26 becomes high again and because of inverting amplifier 64, the signal clamps point 60 to ground, thus terminating the feedback signal from transformer 24.

It is noted that the initiation of the feedback signal is governed by the desaturation of power transistor 18. Since the feedback signal provided over line 54 starts typically 4 microseconds after the switch signal 14 has changed, point 60 will be able to receive the current for approximately 1.2 microseconds, i.e., until the second timing signal clamps point 60 to ground. This charging pulse is provided through point 60 to charge up a capacitor 66 via isolating diode 68. The DC charge provided to capacitor 66 then controls the magnitude of the variable base driver circuit 32.

If the power transistor is in an undersaturated condition, transistor 18 becomes desaturated quicker. As a result, the voltage spike is generated earlier with the result that charging of capacitor 66 is provided for longer than 1.2 microseconds. The DC charge provided in this situation to capacitor 66 is greater. Conversely, if the voltage spike is delayed because of oversaturation of power transistor 18, then the charging pulse occurs later in the cycle and the DC charge on capacitor 66 would be correspondingly less. Thus, the total time of the voltage pulse that is received by capacitor 66 governs the amount of DC charge stored by capacitor 66.

Capacitor 66 in turn controls the amount of base drive for transistor 34 delivered to point 70. As can be seen by the above, feedback circuit 28 makes the magnitude of the feedback pulse proportional to time to control the scan.

More specifically, in parallel with capacitor 66 is a voltage divider of resistors 72 and 78. Current from capacitor 66 is applied through the voltage divider to gain amplifiers 74 and 76. The gain of amplifiers, i.e., NPN transistors 74 and 76, may be high, for example, 1000. Since capacitor 66 has its DC charge changed each cycle, its voltage drives gain amplifiers 74 and 76 which regulate the voltage provided to point 70. Point 70 then provides the current to PNP transistor 34 and also to resistor 80 in feedback relation with the base of PNP transistor 34. Based on this variable current provided to transistor 34, it in turn provides a variable current to power transistor 18.

As the charge is increased on capacitor 66, a higher voltage is supplied to point 70. This increase will, via resistor 80, increase the bias for transistor 34 such that transistor 34 conducts a greater current to transformer 36 resulting in an increase in the amount of base current being provided to PNP transistor 18. Thus, PNP transistor 34 switches a higher current into the base of transistor 18 so that prior to transistor 18 being turned off it has extra base drive. This extra base drive increases the time for transistor 34 to desaturate, and therefore, increases the time when retrace begins. However, with this oversaturated situation, the initiation of feedback signal is delayed and hence, less current is provided to capacitor 66. This will result in the next cycle having less voltage being provided to PNP transistor 34 and less base drive current being delivered to power transistor 18 resulting in faster desaturation of transistor 18.

Thus, essentially, a self-regulating feedback loop which drives the base of transistor 18 with the right amount of base current for saturation is provided. Moreover, as is apparent, this also provides for immediate time correction for the scan cycle. Since the time to desaturate the transistor 18 becomes fixed, the scan of the display device will become fixed also. Since the time when the display of the alphanumeric character is fixed to the timing chain, synchronization of the scan to the characters occurs.

The voltage for the power transistor 34 is provided by a voltage source 84 which provides the source of current through NPN transistor 76 via capacitor 86 and resistor 82 in parallel. Capacitor 86 and resistor 82 provide protection for circuit 32.

Voltage source 84 also supplies current to transistor 18 via resistor 88. In parallel with resistor 88 are capacitors 90 and 92 which act as a DC filter. Diode 94 in series with the primary of transformer 24 is used to recover energy transferred through the transformer. These elements and their usage are well known in the art.

As shown above the phase lock loop, oscillator and time comparator circuits of the prior art have been completely eliminated. Moreover, a simple circuit has been introduced which controls the magnitude of base drive to the power transistor. By doing this, the circuit locks the time of the scan as well as the time retrace begins. Moreover, by the feedback relationship involved, the optimum base drive is provided to the power transistor. Because of these features, the parameters of the power transistor are automatically accounted for. For example, the circuit accounts for a power transistor which has a high beta. This results since the power transistor is driven to cause a storage time with the circuit fixing the amount of charge stored. This charge is related in time because of the properties of the transistor. Thus, time correction is also accomplished by the feedback relationships.

While the invention has been particularly shown and described with reference to a preferred embodiment thereof, it will be understood by those skilled in the art that various changes in form and detail may be made therein without departing from the spirit and scope of the invention. Thus, capacitor 66 storing the charge can be an energy storing element, the feedback signal may come off the primary and the transistor can be replaced by the solid state elements. Thus, it is intended to only be limited by the following claims.

We claim:

1. A circuit for regulating the scan in a video terminal, said circuit comprising:

A. first means for controlling said scan across said video terminal;

B. second means providing a first and second control signal, said first control signal having a fixed period and said second control signal terminating at a predetermined time after initiation of said first control signal;

C. said first means including means responsive to said first control signal for generating a feedback signal;

D. third means responsive to said first means subsequent to said first control signal for storing from said feedback signal a charge prior to the termination of said second control signal; and E. fourth means for varying in response to said charge the conduction of said first means such that the position of said scan is synchronized to said second means.

2. A circuit as defined in claim 1 wherein said first means inclues a power transistor having its base coupled to said fourth means, said power transistor characterized by a variable delay based on its degree of saturation, whereby said degree of saturation of said power transistor effects said charge stored by said third means.

3. A circuit as defined in claim 2 wherein said power transistor, as it becomes more saturated, provides a longer delay in generating said feedback signal, said longer delay resulting in said power transistor becoming less saturated in the next period.

4. A circuit as defined in claim 3 wherein said power transistor is regulated to provide a substantially fixed desaturation time such that said scan is controlled in time.

5. A circuit as defined in claim 1 wherein said varying of such conduction by said fourth means is inversely proportional to the initiation of said generating means such that said initiation of said generating means is synchronized to said second means.

6. A circuit as defined in claim 1 wherein said second means provides a third control signal, said third control signal occurring a predetermined time after said first control signal, said scan in response to said third control signal displaying alphanumeric characters on said video terminal.

7. A circuit as defined in claim 1 wherein initiation of said second control signal is concurrent with initiation of said first control signal.

8. A circuit as defined in claim 1 wherein said first means includes:

A. a power transistor coupled to and responsive to said fourth means, said first control signal enabling said fourth means to remove current from the base of said power transistor; and B. a transformer responsive to said power transistor, said transformer when said power transistor is non-conductive resonating to provide said feedback signal, said third means coupled to said transformer and receiving said feedback signal, said charge from said feedback signal being variable depending on the duration required for said power transistor to become non-conductive.

9. A circuit as defined in claim 1 wherein said third means includes:

A. a capacitor for storing said charge from said first means; and

B. means responsive to said second control signal for inhibiting the transfer of said charge to said capacitor after said termination of said second signal, said capacitor storing a variable voltage.

10. A circuit as defined in claim 9 wherein said fourth means includes a first transistor coupled to said first means and to said third means, said first transistor conductivity being responsive to the variable voltage stored by said third means, said first transistor becoming conductive in response to said first control signal, and said first means in response to said conductive first transistor initiating retrace of said scan.

11. A circuit as defined in claim 10 wherein said first means includes:

A. a power transistor having its base coupled to said output of said first transistor, said power transistor in response to output from said first transistor becoming saturated and in response to said conducting of said first transistor becoming desaturated and non-conducting after a variable time period;

B. a transformer coupled to the emitter of said power transistor, said transformer in response to said non-conduction of said power transistor resonating such that a feedback signal is provided across its secondary, and said scan is retraced; and C. means coupled to the secondary of the said transformer for transferring said feedback signal to said third means, whereby the feedback signal transferred to said third means is variable in time and selectively controls the saturation of said power transistor such that time correction for the operation of said circuit is provided, said time correction based on the feedback relationship of said power transistor and said capacitor such that synchronization to the display of characters on said video terminal is provided.

12. A circuit as defined in claim 11 wherein said second means includes:

A. a voltage source;

B. a plurality of second transistors coupled to said voltage source; and

C. a capacitor coupled to said transferring means and storing a charge prior to termination of said second control signal, the charge on said capacitor controlling the conduction of said second transistors which in turn control the conduction of said first transistor and the saturation of said power transistor.

13. In a video display device wherein information is presented on a screen by a beam moving substantially in one plane, said information being displayed at a fixed time, an apparatus for controlling said beam, such that said information is displayed in the same horizontal location, said apparatus comprising:

A. scanning means for providing said beam across said display device;

B. means for driving said scanning means;

C. first timing means for disabling said driving means such that said scanning means initiates retrace of said beam;

D. feedback means responsive to the output of said driving means when said scanning means initiates retrace for storing a feedback signal provided by said scanning means;

E. second timing means for limiting the duration said feedback signal is provided to said feedback means, said duration when said feedback signal is provided to said feedback means being inversely proportional to the duration when said driving means becomes disabled; and F. control means responsive to said feedback means for varying the magnitude of current to said driving means.

14. An apparatus as defined in claim 13 wherein said disabling of said driving means is characterized by a delay associated with the desaturation of said driving means, said delay being proportional to the oversaturation of said driving means, said feedback means receiving less charge as said delay becomes longer, said feedback means, in turn, providing less charge to said control means such that said driving means becomes less saturated.

* * * * *